US009041761B2

(12) United States Patent
Hamanaka

(10) Patent No.: US 9,041,761 B2
(45) Date of Patent: May 26, 2015

(54) IMAGE FORMING DEVICE WITH SMOOTHING CORRECTION FOR PLURAL LIGHT EMITTING SEGMENTS

(71) Applicants: Kabushiki Kaisha Toshiba, Tokyo (JP); Toshiba Tec Kabushiki Kaisha, Tokyo (JP)

(72) Inventor: Takahiro Hamanaka, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/150,446

(22) Filed: Jan. 8, 2014

(65) Prior Publication Data

US 2014/0192131 A1 Jul. 10, 2014

(30) Foreign Application Priority Data

Jan. 8, 2013 (JP) ..... 2013-001282

(51) Int. Cl.
*B41J 2/385* (2006.01)
*B41J 2/45* (2006.01)
*G03G 15/043* (2006.01)

(52) U.S. Cl.
CPC *B41J 2/45* (2013.01); *G03G 15/043* (2013.01)

(58) Field of Classification Search
CPC ..... B41J 2002/435; B41J 2005/447; B41J 2002/45; G03G 2215/0158; G03G 2215/0409
USPC ..... 347/116, 229, 234, 235, 248–250, 238; 399/301; 382/151
See application file for complete search history.

(56) References Cited

U.S. PATENT DOCUMENTS 6,215,511 B1 * 4/2001 Asako et al. ..... 347/234
7,598,973 B2 10/2009 Tsujino et al.
8,294,744 B2 * 10/2012 Kinoshita et al. ..... 347/234

FOREIGN PATENT DOCUMENTS

JP 2002144628 5/2002
JP 2004-174854 6/2004
JP 2009-000822 1/2009
JP 2010156752 7/2010
JP 2011-197446 10/2011

OTHER PUBLICATIONS

Office Action mailed Sep. 30, 2014, filed in corresponding Japanese Patent Application No. 2013-001282, with English translation.

* cited by examiner

*Primary Examiner* — Hai C Pham
(74) *Attorney, Agent, or Firm* — Patterson & Sheridan LLP

(57) ABSTRACT

An image forming device includes a photoreceptor drum including a target surface that is scanned in a main scanning direction and a sub-scanning direction, an exposure head including a plurality of light emitting segments aligned in parallel to the main scanning direction, an exposure driving unit which selectively drives the plural light emitting segments, a storing unit which stores a profile where the respective positions of the plural light emitting segments correspond to a correction amount from the main scanning direction toward the sub-scanning direction at every position, and a correcting unit which smoothes a local change of the correction amount in the profile.

17 Claims, 11 Drawing Sheets

FIG. 5A
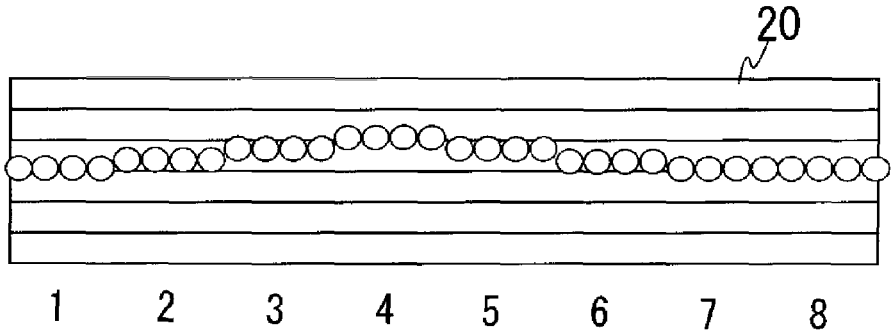
FIG. 5B
40
| POSITION | 1 | 2 | 3 | 4 | 5 | 6 | 7 | 8 |
|---|---|---|---|---|---|---|---|---|
| DEVIATION AMOUNT | 0.0 | 0.3 | 0.6 | 1.1 | 0.7 | 0.3 | 0.0 | 0.0 |
| CORRECTION AMOUNT | 0 | 0 | −1 | −1 | −1 | 0 | 0 | 0 |
FIG. 5C
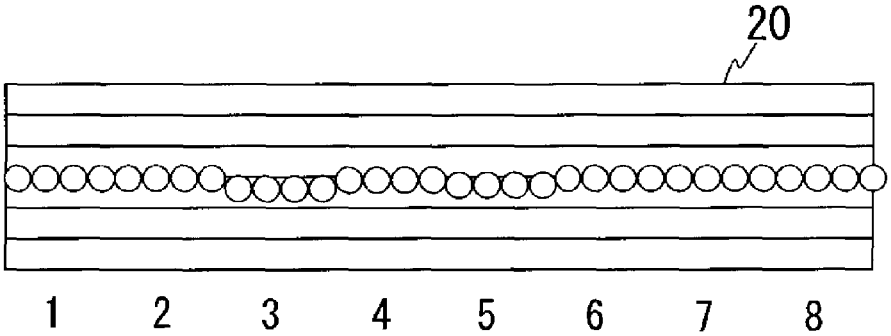

IMAGE FORMING DEVICE WITH SMOOTHING CORRECTION FOR PLURAL LIGHT EMITTING SEGMENTS

CROSS-REFERENCE TO RELATED APPLICATION

This application is based upon and claims the benefit of priority from Japanese Patent Application No. 2013-001282, filed Jan. 8, 2013, the entire contents of which are incorporated herein by reference.

FIELD

Embodiments described herein relate generally to an image forming device.

BACKGROUND

When writing an image onto a photoreceptor drum, a positional deviation in a sub-scanning direction may undergo correction. Hitherto, there has been known an image forming device which compensates a positional deviation in each lens unit with an LED (light emitting diode) array. The positional deviation may be caused by the LED head being deformed and curved as a result of temperature changes. The LED head with an image forming lens may be deformed, for example, by flexing of the lens. A known method for correcting a printing position of an electrophotographic apparatus includes measuring and correcting a positional deviation of the trailing exposure that is caused by deformation.

When correcting a distortion and an inclination of the LED head, an image forming device reflects the distorted state obtained from the LED head or the inclined state obtained according to a positioning control as the correction amount. The correction amount means a delay amount of irradiation timing of the LED head and it is represented by a value indicating how many lines are to be delayed in a sub-scanning direction on the outer peripheral surface of the drum. The image forming device stores in advance correction amount values (for example, 0, 1, and −1) that correspond to every position of a plurality of light emitting segments forming the LED head, and the correspondence relation of the positions and the correction amounts as a profile for the lens unit. An exposure device reads each correction amount in every position of the plural light emitting segments arranged in a main scanning direction and delays the irradiation timing of the respective light emitting segments depending on the respective correction amounts.

However, when correcting for distortion using the correction amount for every position of the light emitting segments stored in advance, the correction amounts may locally change in the main scanning direction, creating a problem that the irregularity of an image becomes significant. On a curve of the profile, a change of the correction amount locally occurs in a range of some positions. A significant change in the size of the correction amount may occur at a position, compared to the correction amounts at the forward and backward positions. For example, in the exposure of one straight line in parallel to the main scanning direction, a deviation in a sub-scanning direction partially occurs along this straight line. Any deviation of an upper or lower step from the straight line causes the image to become visually defective.

DESCRIPTION OF THE DRAWINGS

FIGS. 5A to 5C are views for use in describing the deviation correction according to a profile stored in the storing unit of the image forming device.

DETAILED DESCRIPTION

An image forming device according to an embodiment includes a photoreceptor drum having a target surface that varies as the photoreceptor drum rotates. An exposure head includes a plurality of light emitting segments. An exposure driving unit is configured to adjust an image writing position on the target surface in the sub-scanning direction and to selectively drive the plural light emitting segments. A storing unit is configured to store a profile in which a respective position of each of the plural light emitting segments corresponds to a correction amount from a main scanning line toward the sub-scanning direction at every position. A correcting unit smoothes a local change of the correction amount in the profile according to at least one of a first difference between the correction amount for a local light emitting segment and the correction amount for a first light emitting segment proximate the local light emitting segment in a first direction and a second difference between the correction amount for the local light emitting segment and the correction amount for a second light emitting segment proximate the local light emitting segment in a second direction opposite the first direction.

Hereinafter, the image forming device according to the embodiment will be described with reference to FIGS. 1 to 11. Here, in the respective drawings, the same reference numbers are given to the same components and the overlapping description is omitted.

Figure 1:
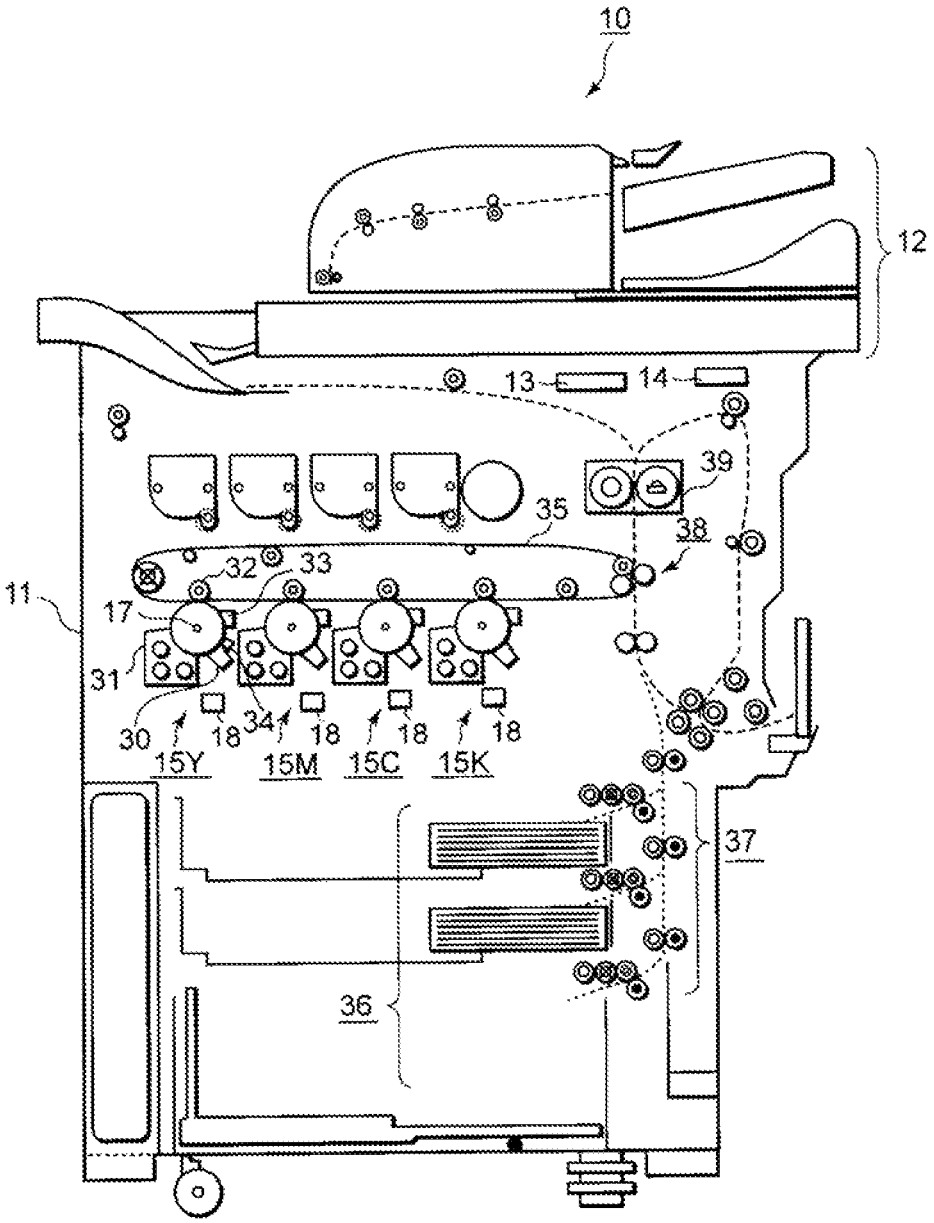
FIG. 1 is a view of an image forming device according to an embodiment.

FIG. 1 is a view of the image forming device according to the embodiment. Multi-functional peripheral (MFP) 10 includes a scanner 12 for scanning a paper surface, an image processing unit 13 for correcting image data, and a line memory 14 for storing line data for four colors, in the main body 11. The MFP 10 also includes an image forming unit 15Y for yellow (Y), an image forming unit 15M for magenta (M), an image forming unit 15C for cyan (C), and an image forming unit 15K for black (K).

Figure 2:
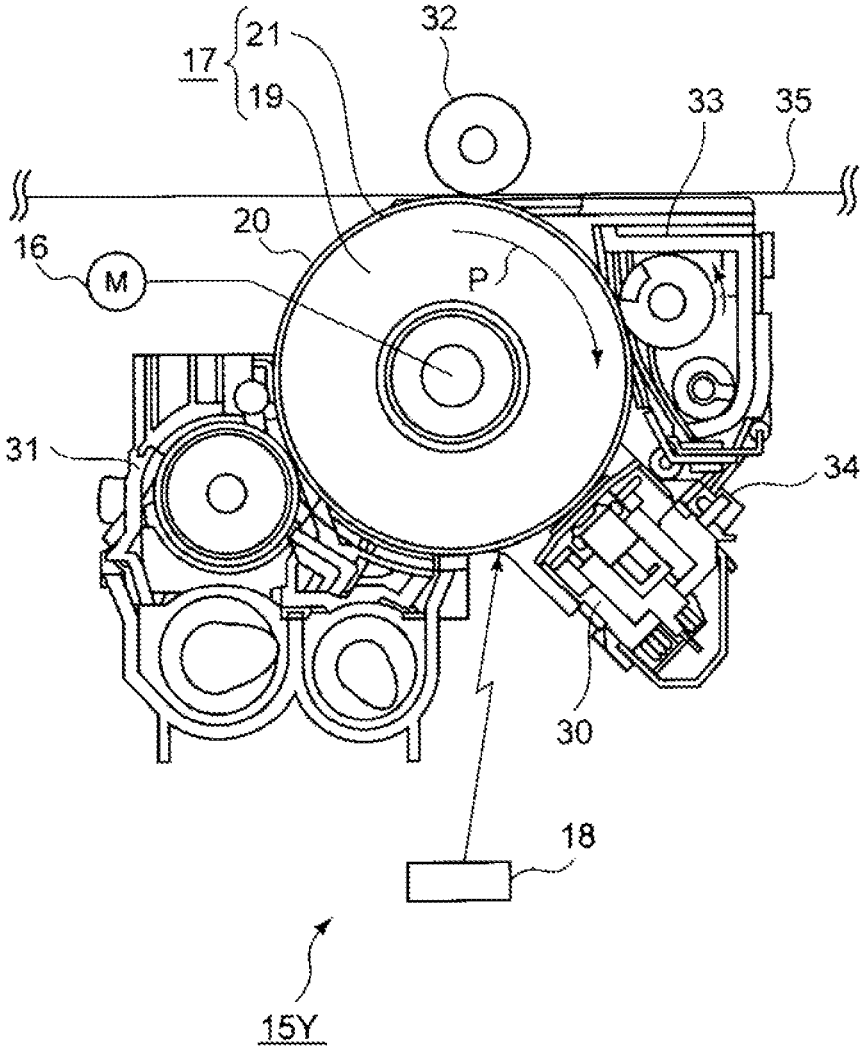
FIG. 2 is a view of a photoreceptor drum of the image forming device.
Figure 3:
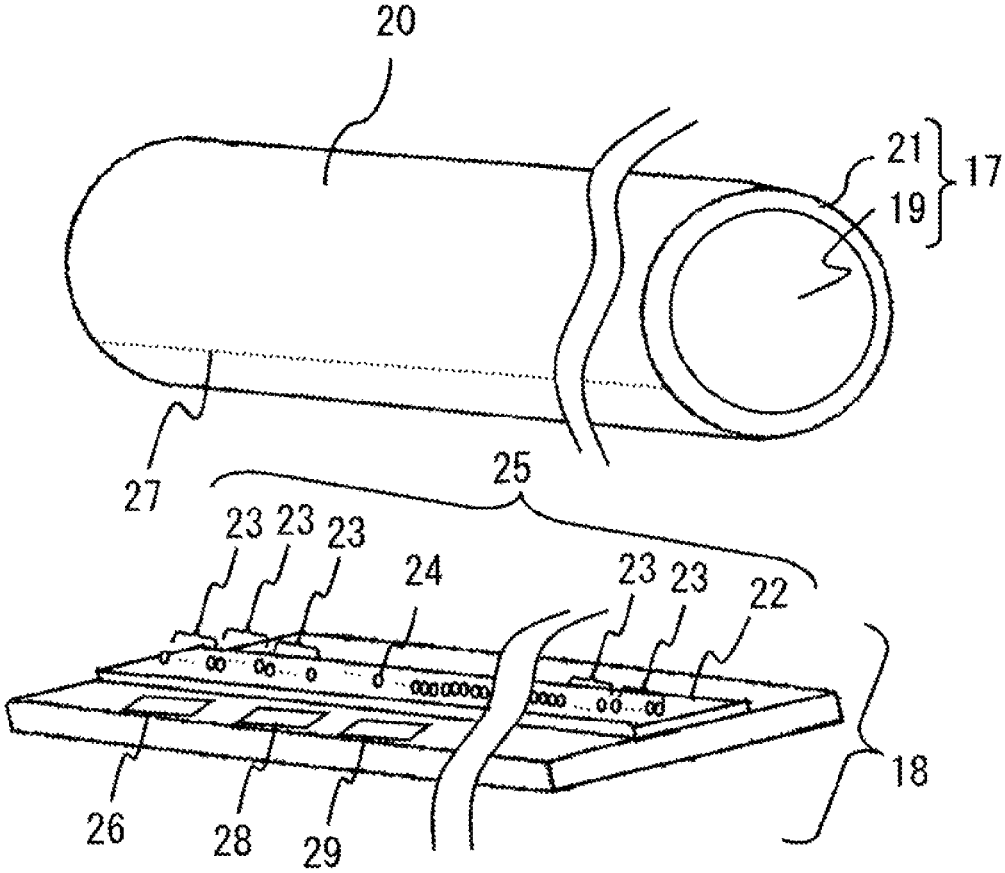
FIG. 3 is a perspective view of an exposure device and the photoreceptor drum including a storing unit and a correcting unit of the image forming device.

FIG. 2 is a view showing an example of one image forming unit 15Y. FIG. 3 is a perspective view of a photoreceptor drum 17 and an exposure device 18. In FIG. 3, the other elements are omitted.

The image forming unit 15Y includes the photoreceptor drum 17 which rotates in the direction of an arrow P according to a motor 16 and the exposure device 18 which forms an electrostatic latent image on the photoreceptor drum 17. The photoreceptor drum 17 includes a drum 19 and a cylindrical photoreceptor 21. The photoreceptor drum 21 is provided on the outer peripheral surface of the drum 19, having a target exposure surface 20 which is scanned in a main scanning direction and a sub-scanning direction orthogonal to the main scanning direction.

The exposure device 18 is provided with an LED head 25 (exposure head) including a case 22 arranged in parallel to the main scanning direction of the photoreceptor drum 17, a plurality of light emitting segments 23 respectively aligned in the case 22. A plurality of LEDs 24 (light emitting elements) is provided for every light emitting segment 23. The exposure device 18 is further provided with an exposure driving unit 26 for adjusting the position of image writing in the sub-scanning direction on the photoreceptor 21 through optical beam from this LED head 25, and selectively driving a plurality of light emitting segments 23. The exposure device 18 includes a storing unit 28 for storing a profile in which the respective positions in the main scanning direction of the plural light emitting segments 23 by the exposure driving unit 26 correspond to the respective correction amounts for delayed deviation of pigment from the main scanning line 27 toward the sub-scanning direction for every position. Furthermore, the exposure device 18 includes a correcting unit 29 for smoothing a locally changed correction amount within a range in the profile, according to a single difference (between the locally changed correction amount and the correction amount obtained either before or after the locally changed correction amount) or according to two differences (between the locally changed correction amount and the correction amount obtained before and between the locally changed correction amount and the correction amount obtained after).

The photoreceptor 21 of the photoreceptor drum 17 forms an area for 7,000 or more effective pixels in an area excluding the both ends in the shaft direction with 600 dpi (dot per inch). The LED head 25 includes a plurality of LEDs 24 for emitting lights respectively to the image areas. With 600 dpi, 96 or 192 LEDs 24 are integrated on one chip. In the example of forming one light emitting segment 23 by one chip, the LED head 25 includes 38 light emitting segments 23.

The exposure driving unit 26 turns the electricity supplied to the plural LEDs 24 on and off. The exposure driving unit 26 defines one light emitting segment 23 as a unit for control. The function of the exposure driving unit 26 is executed by, for example, large scale integration (LSI).

The storing unit 28 is a memory for storing the distorted state in every light emitting segment 23. The distortion refers to a pigment deviation in the sub-scanning direction. The data of the profile is table data indicating a correspondence between the respective positions of the light emitting segments 23 and the respective correction amounts at the corresponding positions. Specifically, each number for the positions of 38 light emitting segments 23 corresponds to each delay amount of a pixel previously generated for the corresponding number. The profile stores, for example, a relation that with respect to the light emitting segment 23 positioned in the number "3", the timing of irradiating the optical beam from this light emitting segment 23 is delayed by the pigment "−1". The storing unit 28 is formed, for example, by a register memory within an application specific integrated circuit (ASIC) or by the ROM in the software.

The correcting unit 29 performs a distortion correction for correcting a distortion of the LED head 25 through the profile and a smoothing correction for smoothing a change generated in a profile curve with this profile represented by a curve. In the smoothing correction, the correcting unit 29 obtains a difference between the correction amount at the current position N and the correction amount at a former position N−1 (where N−1 indicates the integer of 1 and more) and a difference between the correction amount at the current position N and the correction amount at a latter position N+1, for three continuous positions within a range locally changing on the profile curve. The correcting unit 29 then compares the two differences thus obtained. The current position means the middle position of the three continuous light emitting segments 23. The correcting unit 29 is provided with a program described by the comparison algorithm and performs the smoothing correction according to the algorithm.

As explained further below, the algorithm obtains the correction amount of the light emitting segment 23 at the former position N−1 of the light emitting segment 23 relative to the current position N and the correction amount of the light emitting segment 23 at the latter position N+1 than the light emitting segment 23 at the current position N and determines whether or not these correction amounts are equal. Further, when the above result is positive, the algorithm changes the correction amount at the current position N by one of the two correction amounts (Act B8 in FIG. 8). According to the change processing, the correction amount is substantially smoothed. Further, when the above result is negative, the algorithm adopts the correction amount which is nearer to the correction amount by the light emitting segment 23 at the current position N, of the two correction amounts and changes the correction amount at the current position N by this correction amount (Acts B11 and B12 in FIG. 8). The function of the correcting unit 29 is performed through, for example, ASIC.

In FIG. 2, the image forming unit 15Y includes an electrifying unit 30, a developer 31, a primary transfer roller 32, a cleaner 33, and a static charge eliminator 34. The electrifying unit 30 electrifies the photoreceptor 21, to create a uniform potential on the target exposure surface 20. The developer 31 develops an electrostatic latent image on the photoreceptor 21 in the developing bias potential. The primary transfer roller 32 primarily transfers the toner image on the photoreceptor drum 17 to a belt 35. The cleaner 33 eliminates the toner left on the photoreceptor drum 17 after the primary transfer. The cleaner 33 may scrape off the toner. The static charge eliminator 34 eliminates the electric charge on the photoreceptor drum 17.

The structure of the image forming units 15M, 15C, and 15K in FIG. 1 is substantially the same as the structure of the image forming unit 15Y. The MFP10 includes a sheet feeder 36 where sheets are set in each tray and a carrying mechanism 37 for carrying a sheet from the sheet feeder 36 to a secondary transfer position. The MFP10 includes a secondary transfer unit 38 for transferring a toner image of four colors on the belt 35 to a sheet and a fixing unit 39 for fixing the toner image on the sheet.

When an original document is set in the MFP10 having the above structure, the scanner 12 outputs an image signal through scanning. The image processing unit 13 creates image data of four colors. The image processing unit 13 arranges the timings of the image data of four colors in order at the line intervals. A line memory 14 arranges the image data of four colors in a line in the sub-scanning direction. In the exposure device 18, the exposure driving unit 26 performs a delay control in the sub-scanning direction, to correct the position of the image according to the intervals of the photoreceptor drums 17 of Y, M, C, and K. The exposure driving unit 26 fixes the position of the LED head 25 in the main scanning direction, to make the LED head 25 print out. The distortion of the LED head 25 can be corrected by partially adjusting the image writing position in the sub-scanning direction.

Figure 4A:
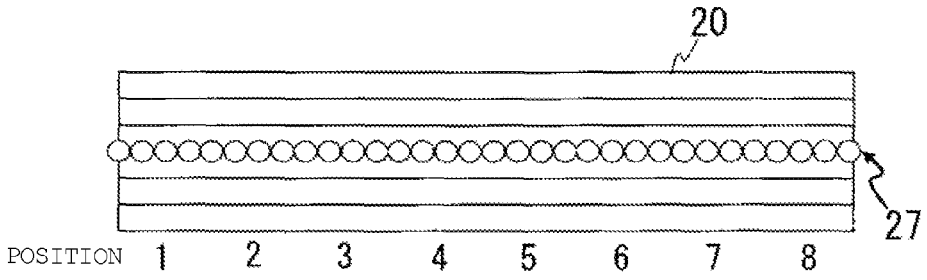
FIGS. 4A to 4C are views each showing an example of deviation correction by the correcting unit of the image forming device.
Figure 4B:
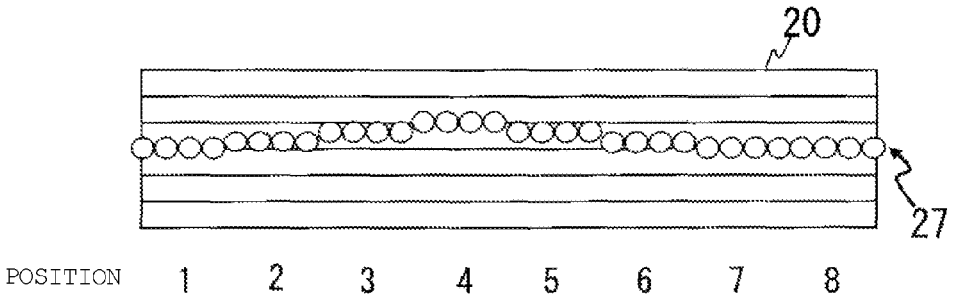
Figure 4C:
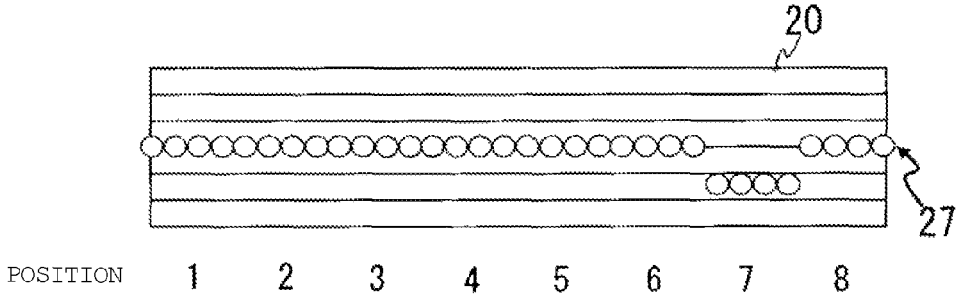

The correcting unit 29 corrects the distortion of the main scanning line generated in the sub-scanning direction. FIGS. 4A to 4C are views each showing an example of the distortion correction. FIGS. 4A to 4C show an example of the electrostatic latent image on the photoreceptor drum 17 of one color. A circle indicates a beam spot of the optical beam by the LED 24. An example with four LEDs 24 per one chip is shown there. The numbers 1 to 8 indicate the positions of the light emitting segments 23 from one end to the other end in the main scanning direction on the target exposure surface 20 of the photoreceptor 21. Further, FIGS. 4A to 4C show a plurality of horizontal lines, which indicate virtual lines in parallel to the main scanning line 27. Of the horizontal lines, the upper horizontal line is a line to be written first in time and the lower horizontal line is a line to be written later in time. A distance between the horizontal lines corresponds to one line. As illustrated in FIG. 4A, in the exposure in a state of all the light emitting segments 23 aligned, the optical beam from the LED 24 is irradiated on the photoreceptor drum 17 in one line. The LED head 25 itself may be deformed and curved by a temperature, and the LED heads 25 for four colors have a deviation respectively in the trailing exposure. When no distortion correction is performed, as illustrated in FIG. 4B, a distortion is generated, for example, in the upper portion, because of a flexure with respect to the main scanning line 27. Alternatively, as illustrated in FIG. 4C, because of a mounting error in chips, for example, a distortion occurs in the lower portion, as for the main scanning line 27. The distortion correction for the other three colors is substantially the same as that in the example of FIGS. 4A to 4C. The correcting unit 29 corrects the printing deviation of each color through the distortion correction.

FIGS. 5A to 5C are views for use in describing the distortion correction according to the respective profiles. In the drawings, an example where four LEDs 24 form one light emitting segment 23 is illustrated. FIG. 5A is a view indicating an exposure example (in this case, the exposure shown in FIG. 4B) before correcting the distortion. FIG. 5B is a view showing one example of the profile. In the profile 40, the number position corresponds to the correction amount having an integer. A deviation amount showing the distorted state may be added correspondingly to the above. For example, as for the position 4, the fact that the deviation amount is 1.1 is previously obtained through measurement and the correction amount is the value with the deviation amount represented by the integer. The integer is stored in advance in the storing unit 28. The exposure driving unit 26 can read how may lines the irradiation timing of the light emitting segment 23 is delayed in the sub-scanning direction. FIG. 5C is a view showing the exposure example after the distortion correction. For example, the light emitting segment 23 at the position 5 has the correction amount "−1". The corrected state of FIG. 5C is obtained by the exposure driving unit 26 driving the LED head 25 according to the same correction amount. The LED heads 25 for the four colors (e.g., cyan, yellow, magenta and black) are driven to emit lights according to the signals demodulated by the line data of the respective colors.

Hereinafter, the description will be made by way of example, taking the case of performing the smoothing correction on the distortion correction of the LED head at position 2.

Figure 6:
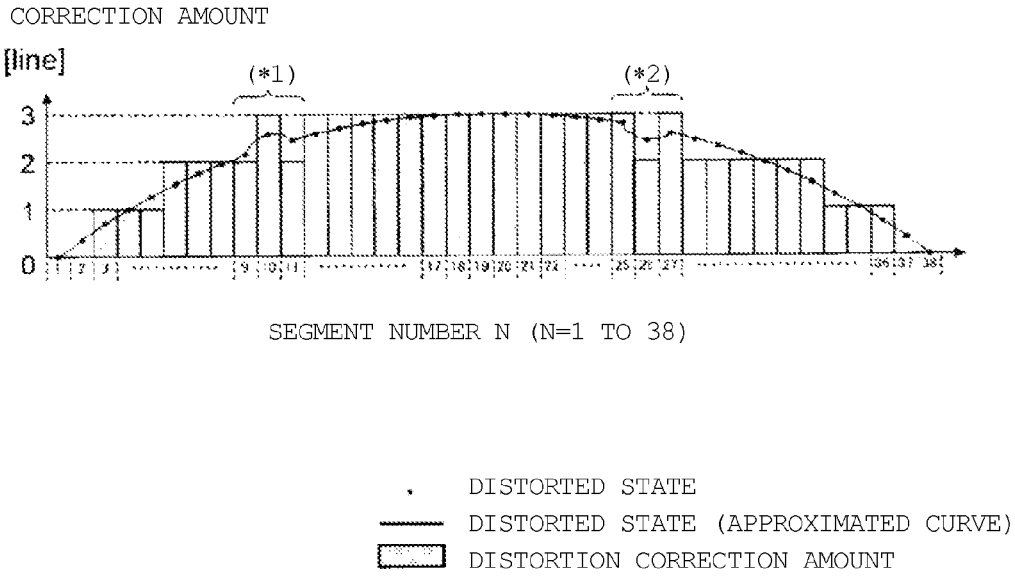
FIG. 6 is a view showing a profile example in the storing unit of the image forming device.

FIG. 6 is a view of a profile example of the storing unit 28 according to the image forming device of the embodiment, showing the profile before the smoothing correction, and after the distortion correction. The horizontal axis in FIG. 6 shows the segment number N (N=1 to 38) indicating the position of the light emitting segment 23. The vertical axis is represented by the integer indicating the correction amount. A black point "•" is a plot indicating the distorted state. The curve connecting a plurality of plots is a profile curve indicating a distorted state in every segment (N=38 in the embodiment) in the main scanning direction and representing the distorted states by approximate curve.

Figure 7:
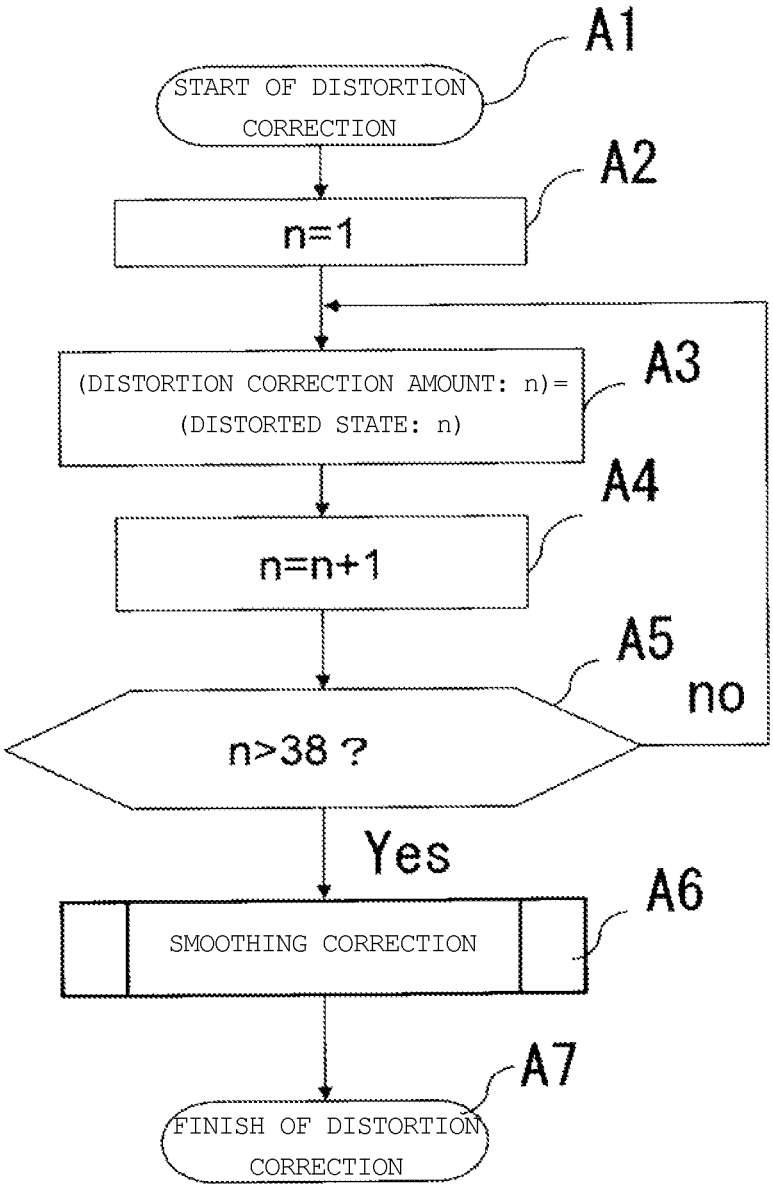
FIG. 7 is a flow chart illustrating the deviation correcting processing by the correcting unit of the image forming device.

FIG. 7 is a flow chart for use in describing the distortion correction processing according to the correcting unit 29. The correcting unit 29 performs this processing, for example, at the activation of the MFP 10. In Act A1, the correcting unit 29 starts the distortion correction. In Act A2, the correcting unit 29 sets a repetitive variable n (n indicates the integer) to 1.

In Act A3, the correcting unit 29 reads the value of the distorted state (FIG. 6) and the value is set at the n-th distortion correction amount. In this Act A3, the correcting unit 29 obtains the n-th distortion correction amount through rounding from the read value. In Act A4, the correcting unit 29 increases the repetitive variable n by one. In Act A5, the correcting unit 29 determines whether or not to exit the repetitive loop. In Act A5, when the repetitive variable n is equal to the arrangement number or smaller than the arrangement number, passing through the route No, the correcting unit 29 performs the processing of Act A3. By repeatedly performing the processing of Act A3 to Act A5, the correcting unit 29 generates profile data for 38 light emitting segments 23. As illustrated in FIG. 6, the profile 40 having the correction amount 0, 0, 1, 1, 1, 2 . . . , respectively for the numbers 1, 2, 3, 4, 5, 6 . . . , is extracted from random access memory (RAM). In Act A5, when the repetitive variable n exceeds the arrangement number, passing through the route Yes, the correcting unit 29 performs the smoothing correction in Act A6.

Figure 8:
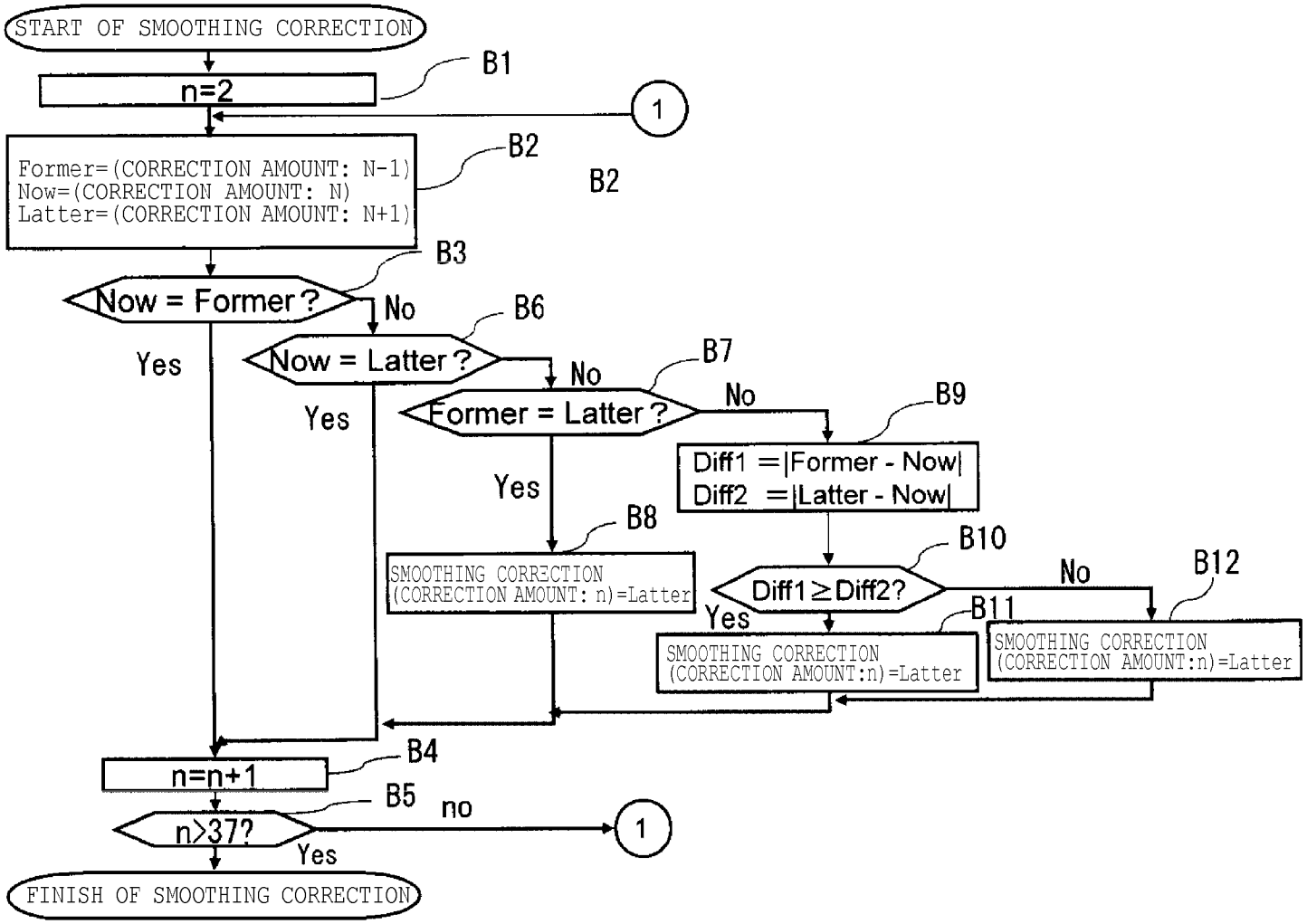
FIG. 8 is a flow chart illustrating a smoothing correction by the correcting unit of the image forming device.

FIG. 8 is a flow chart for use in describing the smoothing correction (Act A6 of FIG. 7) by the correcting unit 29 of the image forming device according to the embodiment. The correcting unit 29 performs the smoothing correction sequentially from the segment number N=2 to 37 because it performs the smoothing correction on some segment number, using the correction amounts of the segments before and after the segment. By way of example, the processing will be performed as follows.

In Act B1, the correcting unit 29 sets the repetitive variable n to 2. The reference n is to show the integer different from the example of FIG. 7.

In Act B2, the correcting unit 29 reads the profile 40 stored in RAM and sets the correction amounts as for the continuous three positions respectively at three variables. Namely, the correcting unit 29 sets the correction amounts of the number n−1, n, and n+1 respectively as Former, Now, and Latter. The variables Former, Now, and Latter indicate the variables for storing the three continuous correction amounts.

In Act B3, the correcting unit 29 compares the correction amount of the current number 2 to the correction amount of the former number 1. When the repetitive variable n is 2, since the correction amount of the number 2 is equal to the correction amount of the former number 1, the condition (Now=Former?) is satisfied. In Act B3, the correcting unit 29 leaves the correction amount of the current number 2 as is, and passing through the route Yes, the correcting unit 29 increases the repetitive variable n by one in Act B4. In Act B5, the correcting unit 29 determines whether or not the repetitive variable n is smaller than the arrangement number by one. In Act B5, when the above result is "No", passing through the route No, the correcting unit 29 returns to the processing of Act B2.

Continuously, in Act B2, the correcting unit 29 performs the processing in the case of the current number n=3. In Act B3, as illustrated in FIG. 6, since the correction amount 1 of the number 3 is larger than the correction amount 0 of the former number 2, passing through the route No, the correcting unit 29 compares the correction amount of the number 3 to the correction amount of the latter number 4, in Act B6. As illustrated in FIG. 6, the correction amount of the number 3 is equal to the correction amount of the number 4. The condition (Now=Latter?) is satisfied. In Act B6, since the correction amount of the current number 3 is equal to the correction amount of N=4, the correcting unit 29 leaves the correction amount of the current number 3 as is, and passing through the route Yes and passing through the processing of Act B4 and Act B5, the correcting unit 29 returns to the processing of Act B2.

Continuously, referring to the correction amount on the curve of FIG. 6, the correcting unit 29 further sets three variables as for the current number 4 (Act B2), determines that the correction amounts are identical between the number 4 and the number 3 (route Yes in Act B3) and increases the repetitive variable n by one (Act B4, Act B5, and Act B2). The processing by the correcting unit 29 in the case of the current number 5 as for the next repetitive variable n is the same as that in the case of the current number 4. Further, in the case of the current number 6, passing through the processing of Act B3 and Act B6, the correcting unit 29 increases the repetitive variable n by one (Act B4, Act B5, and Act B2). The correction amount does not vary at the positions 6 to 9 of FIG. 6. Similarly, in the case of the current number 7, 8, and 9, the correcting unit 29 increases the repetitive variable n by one (Act B4, Act B5, and Act B2).

Continuously, in the case of the current number 10, as shown in FIG. 6, the correction amount 3 of the current number 10 is larger than the correction amount 2 of the former number 9. The correcting unit 29 goes through the route No in Act B3 and compares the correction amount 3 of the number 10 to the correction amount of the latter number 11 in Act B6. The correction amount of the number 10 is larger than the correction amount of the number 11. In Act B6, going through the route No, the correcting unit 29 compares the correction amount of the former number 9 to the correction amount of the latter number 11 in Act B7. When the current number N=10, as shown in FIG. 6, the correction amount is identical between the former and latter light emitting segments 23. The condition (Former=Latter?) is satisfied. In Act B7, passing through the route Yes, the correcting unit 29 performs the smoothing correction in Act B8. In Act B8, the correcting unit 29 performs the smoothing correction with respect to the current number 10, using the correction amount of N=11. In Act B8, instead of the correction amount in the latter stage, Latter, the correction in the former stage, Former, maybe used, because the condition (Former=Latter?) is satisfied.

Figure 9:
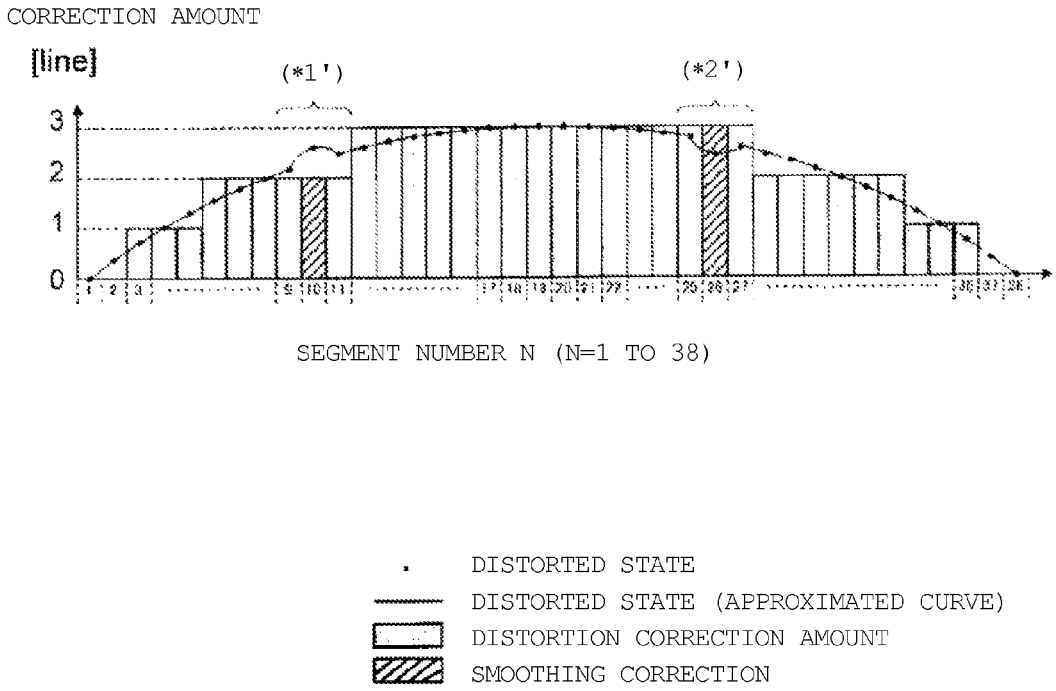
FIG. 9 is a view showing a profile example after the smoothing correction by the correcting unit of the image forming device.

FIG. 9 is a view showing a profile example after the smoothing correction by the correcting unit 29 according to the image forming device of the embodiment. As illustrated in FIGS. 6 and 9, the correction amount of the number 10 is corrected from 3 to 2. In the profile curve of FIG. 6, the correction amount of the light emitting segment 23 has a convex portion locally at the position 10 and is protruding. A degree of a change in the correction amount is smoothed in the range of the number 10, the former number 9, and the latter number 11.

In Act B8 of FIG. 8, the correcting unit 29 sets the correction amount after smoothing as for the number 10 and performs the processing of Act B4, Act B5, and Act B2, passing through the route Yes. As shown in FIG. 6, since the correction amount of the next current number 11 is equal to the correction amount of the number 10 smoothed and corrected, the correcting unit 29 performs the processing of Act B2, B3, B4, and B5.

Similarly, as shown in FIGS. 6 and 8, in the numbers 12 to 25 of the repetitive variable n, the correcting unit 29 gets out from the processing loop without smoothing correction and increases the repetitive variable n by one (Act B2, Act B3, Act B4, and Act B5).

In the case of the current number 26, in FIG. 6, the correction amount 2 of the number 26 is smaller than the correction amount 3 of the former number 25. Passing through the route No in Act B3, the correcting unit 29 compares the correction amount of the number 26 to the correction amount of the latter number 27 in Act B6. The correction amount of the number 26 is smaller than the correction amount of the number 27. Passing through the route No in Act B6, the correcting unit 29 determines that the correction amount is identical between the numbers before and after the number 25 in Act B7. Since the condition (Former=Latter?) is satisfied, passing through the route Yes, the correcting unit 29 uses the correction amount 3 according to the variable Latter or the variable Former, to perform the smoothing correction in Act B8. As illustrated in FIGS. 6 and 9, the correction amount of the number 26 is corrected from 2 to 3. The correction amount had a concave portion locally at the position of the number 26. According to the smoothing correction, it is smoothed in the range of the number 26, the former number 25, and latter number 27.

Hereinafter, in the numbers from 27 to 38 of the repetitive variable n, the correcting unit 29 gets out from the processing loop without smoothing correction and increases the repetitive variable n by one (Act B2, Act B3, Act B4, and Act B5 in FIG. 6). In the case of the current number n=38, when the determination result is positive in Act B5, passing through the route Yes, the correcting unit 29 finishes the smoothing processing. In Act A7 of FIG. 7, the correcting unit 29 finishes the distortion correction processing.

Figure 10:
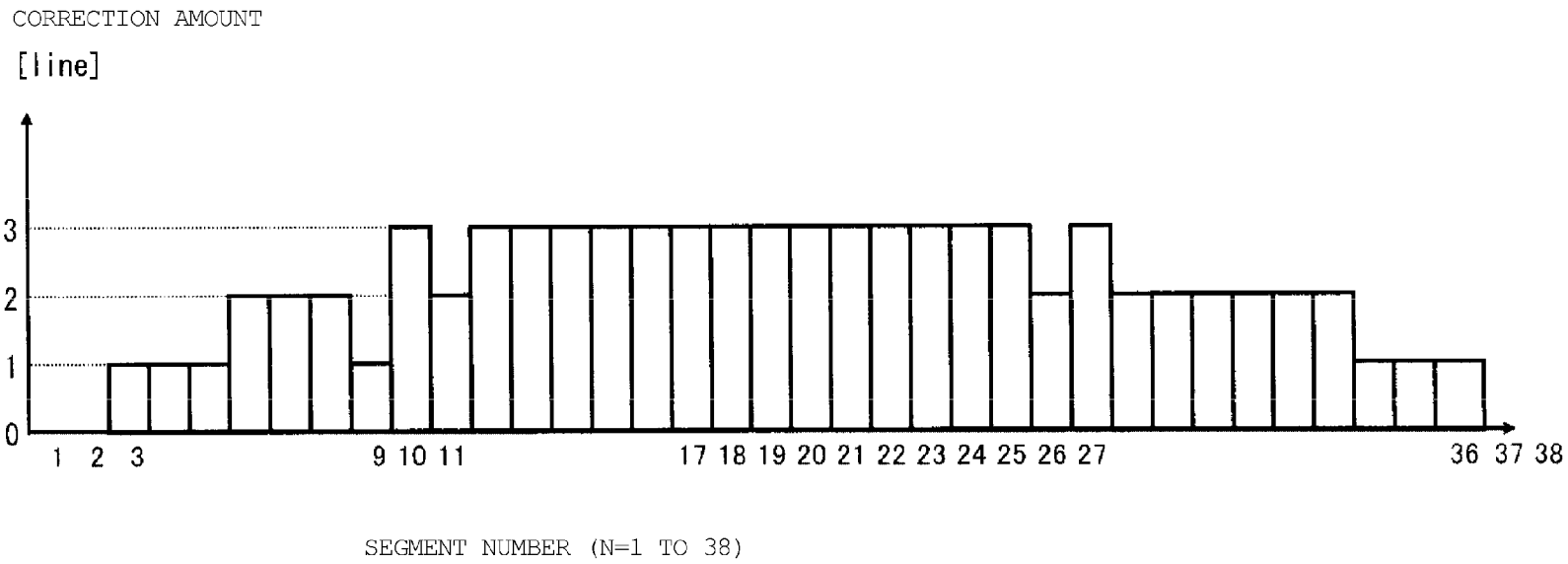
FIG. 10 is a view showing another profile example of the storing unit.

Although the processing of Act B8 in FIGS. 6 and 9 is the case where the correction amount is identical between the former and latter numbers of the current number, FIG. 10 shows an example of a profile having a range in which the correction amount is different between the former and latter numbers of the current number.

FIG. 10 is a view showing another example of a profile of the storing unit 28 according to the image forming device of the embodiment. FIG. 10 shows the profile before the smoothing correction. In FIG. 10, the correction amount of the number 9 is different from that in FIG. 6.

Referring to FIG. 8, in the case of the current number 10, the correcting unit 29 determines that the correction amount 3 of the number 10 is larger than the correction amount 1 of the former number 9 (Act B3), and passing through the route No, it compares the correction amount of the number 10 and the correction amount of the number 11 (Act B6). Since the comparison result is negative, passing through the route No, the correcting unit 29 compares the correction amount of the number 9 before the current number 10 to the correction amount of the latter number 11 (Act B7). The variable Former is not equal to the variable Latter. When the above check result of "Former=Latter?" in Act B7 is "No", passing through the route No, the correcting unit 29 obtains a difference between the correction amount of the number 10 at the current position and the correction amount of the number 9 and a difference between the correction amount of the number 10 at the current position and the correction amount of the number 11, in Act B9. The correcting unit 29 then compares the two differences with each other. Specifically, the correcting unit 29 obtains a difference Diff1 between the correction amount 3 in the current segment and the correction amount 1 in the former segment. The correcting unit 29 obtains a difference Diff2 between the correction amount 3 in the current segment and the correction amount 2 in the latter segment.

In Act B10, the correcting unit 29 compares the first difference Diff1 to the second difference Diff2. In Act B10, when Diff1≥Diff2, passing through the route Yes, the correcting unit 29 performs the smoothing correction, using the correction amount 2 in the latter segment, in Act B11. The correction amount in the number 10 is corrected from 3 to 2. In Act B10, when Diff1<Diff2, passing through the route No, the correcting unit 29 performs the smoothing correction, using the correction amount in the former segment, in Act B12. The correction amount of the number 10 is corrected from 3 to 1. In short, in Act B10 to B12, the correcting unit 29 adopts the correction amount nearer to the current correction amount, of the correction amounts in the former and latter segment numbers 9 and 11, as the current correction amount. According to this, irregularity of an image accompanying the correction can be evenly moderated.

In a control without any smoothing correction performed in the distortion correction (FIG. 6), the correcting unit 29 uses the value of the distorted state obtained from the memory for storing the distorted state (the storing unit 28) as it is without processing it. The correcting unit 29 reflects the above to the distortion correction amount in every line unit. In this case, a change in the correction amount locally occurs in (*1) and (*2) of FIG. 6. Through the correction, irregularity of the image locally becomes reduced.

In a control according to the image forming device of the embodiment, as illustrated in FIG. 9, after the value of the distorted state is reflected in the storing unit 28 as the correction amount, the correction amount of each segment position is optimized through the smoothing correction by the correcting unit 29. The correcting unit 29 approximates a plurality of correction amounts belonging to a range in which the correction amount varies, according to the correction amounts at two outside positions of the range. According to the smoothing correction of approximating the correction amounts so as to cancel a local change in the correction amount, the image writing position in the sub-scanning direction is partially adjusted. In the drawings, as illustrated by (*1') and (*2'), the portion with a change locally generated in the correction amount is smoothed. The local irregularity of image accompanying the correction is moderated.

Distortion occurs due to various factors within the LED head 25, besides deformation by temperature. Mounting a plurality of light emitting segments 23 in one line may cause an error in linearity of the line. Distortion occurs between chips as the light emitting segments 23. In the adjacent chips, the pitch interval is sometimes deviated from a predetermined pitch interval between the LED 24 on one end in one chip and the LED 24 on the other end in the other chip. In order to cope with the distortion of the LED head 25, there is provided an image forming device that executes the smoothing correction as instructed by software. Since a change in the correction amount does not occur at a short interval in the main scanning direction, irregularity of an image is locally eased, which can moderate the image deviation in a stepped shape accompanying the distortion.

Variation Example

In the above embodiment, the LED head 25 may be provided with a lens 42 for imaging the lights from the plural light emitting segments 23 on the outer peripheral surface of the photoreceptor drum 17.

Figure 11:
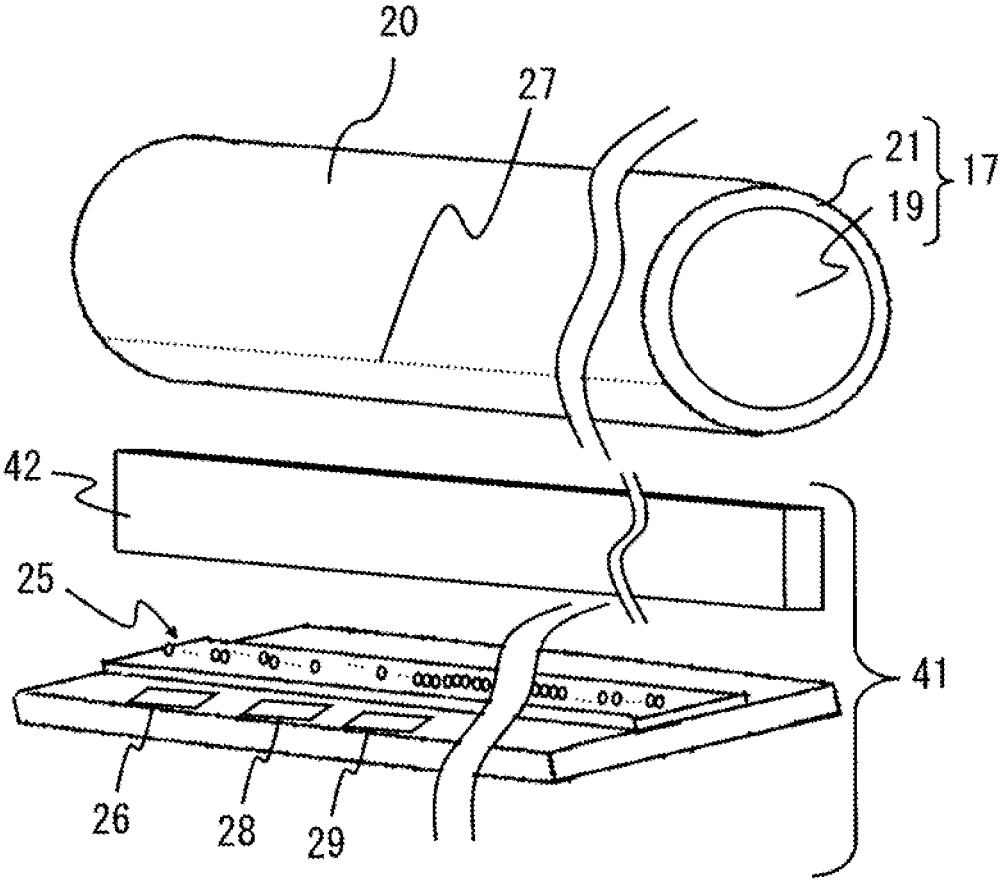
FIG. 11 is a perspective view of an exposure device and a photoreceptor drum including the storing unit and the correcting unit of an image forming device according to a modification of the embodiment.

FIG. 11 is a perspective view of an exposure device and a photoreceptor drum including a storing unit and a correcting unit of an image forming device according to a variation of the embodiment. In the exposure device 41, a lens 42 is provided for the LED head 25. The lens 42 is an imaging lens. There maybe some cases in which a deflection or flexing caused by a temperature change may occur in the lens 42 itself. The correcting unit 29 smoothes the change in the correction amount caused by the light from the lens 42. Even when there occurs flexing of the LED head 25 itself or flexing of the lens 42, affected by the temperature, the image forming device according to the variation example of the embodiment can perform the smoothing correction as instructed by software.

The above embodiment is not restrictive but can be realized by modifying the component elements in a practical step within the scope without departing from the spirit thereof.

Although in the above embodiment, the exposure device 18 uses LED emission, the exposure device 18 may perform the smoothing correction of the above example by using an exposure head through laser emission, for example.

The execution timing of the processing of FIG. 7 maybe modified to times other than the activation time. For example, it maybe the timing when the number of the times of the exposure processing by the exposure device 18 exceeds a predetermined threshold value. Alternatively, it may be the timing when the correcting unit 29 is called from the main controller according to a user's operation.

Further, in the above example, the correction amount is determined in every light emitting segment 23. The correction amounts of the plural LEDs 24 have an average value among these LEDs 24 and the plural LEDs 24 belonging to one chip are subjected to a delay of the irradiation timing all with the average correction amount. The unit of the delay processing by the correction amount may be changed.

The number of the LEDs 24 and the number of the light emitting segments 23 are shown only as an example and these numbers may be modified. The distortion correction of the LED head 25 may be performed together with the inclination correction.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming device comprising:

a photoreceptor drum including a photoreceptor having a target surface that is scanned in a main scanning direction and a sub-scanning direction orthogonal to the main scanning direction;

an exposure head including a plurality of light emitting segments aligned in parallel to the main scanning direction of the photoreceptor drum, wherein each light emitting segment includes a plurality of light emitting elements;

an exposure driving unit configured to adjust an image writing position on the target surface in the sub-scanning direction and to selectively drive the plural light emitting segments;

a storing unit configured to store a profile in which a respective position of each of the plural light emitting segments corresponds to a correction amount from the main scanning direction toward the sub-scanning direction at every position; and a correcting unit configured to smooth a local change of the correction amount in the profile according to at least one of a first difference between the correction amount for a local light emitting segment and the correction amount for a first light emitting segment proximate the local light emitting segment in a first direction and a second difference between the correction amount for the local light emitting segment and the correction amount for a second light emitting segment proximate the local light emitting segment in a second direction opposite the first direction, wherein for each of the continuous light emitting segments, the correcting unit obtains the correction amount for the first light emitting segment and the correction amount for the second light emitting segment, and determines whether or not the obtained correction amounts are equal so that:

when the obtained correction amounts are determined to be equal, the correcting unit changes the correction amount for the current local light emitting segment according to one of the obtained correction amounts, and when the obtained correction amounts are determined to not be equal, the correcting unit corrects the correction amount of the current local light emitting segment to the obtained correction amount which is nearer in value to the correction amount of the current local light emitting segment.

2. The device according to claim 1, wherein the correcting unit obtains the first difference and the second difference, and compares the differences with each other.

3. The device according to claim 1, wherein the correcting unit approximates the plural correction amounts within the range of the change according to the correction amounts at the outside positions in the range.

4. The device according to claim 1, wherein the exposure head includes a lens for imaging light from the plural light emitting segments to the variable target surface, and the correcting unit smoothes a correction amount generated to correct the passage of the light from the plural light emitting segments through the lens.

5. The device according to claim 1, wherein the plurality of light emitting elements are light emitting diodes.

6. The device according to claim 1, wherein the plurality of light emitting elements are lasers.

7. An image forming method comprising:

exposing a photoreceptor drum with a plurality of light emitting segments aligned in parallel to a main scanning direction, wherein each light emitting segment includes a plurality of light emitting elements, and wherein the photoreceptor drum includes a photoreceptor having a target surface that is scanned in the main scanning direction and a sub-scanning direction orthogonal to the main scanning direction;

adjusting an image writing position on the target surface in the sub-scanning direction and selectively driving the plural light emitting segments;

storing a profile in which a respective position of each of the plural light emitting segments corresponds to a correction amount from the main scanning direction toward the sub-scanning direction at every position; and smoothing a local change of the correction amount in the stored profile according to at least one of a first difference between the correction amount for a local light emitting segment and the correction amount for a first light emitting segment proximate the local light emitting segment in a first direction and a second difference between the correction amount for the local light emitting segment and the correction amount for a second light emitting segment proximate the local light emitting segment in a second direction opposite the first direction, wherein said smoothing includes approximating the plural correction amounts within the range of the local change, according to the correction amounts at outside positions in the range.

8. The method according to claim 7, wherein said smoothing comprises:

obtaining the first difference and the second difference; and comparing the differences with each other.

9. The method according to claim 7, wherein said smoothing comprises:

for each of the continuous light emitting segments, obtaining the correction amount for the first light emitting segment and the correction amount for the second light emitting segment, and determining whether or not the obtained correction amounts are equal so that:

when the obtained correction amounts are determined to be equal, the correction amount for the current local light emitting segment is changed according to one of the obtained correction amounts, and when the obtained correction amounts are determined to not be equal, the correction amount of the current local light emitting segment is changed to the obtained correction amount which is nearer in value to the correction amount of the current local light emitting segment.

10. The method according to claim 7, wherein the exposure head includes a lens for imaging light from the plural light emitting segments to the target surface, the method further comprising:

smoothing a correction amount generated to correct the passage of the light from the plural light emitting segments through the lens.

11. The method according to claim 7, wherein the plurality of light emitting elements are light emitting diodes.

12. The method according to claim 7, wherein the plurality of light emitting elements are lasers.

13. A non-transitory computer-readable medium storing instructions for an image forming device, the instructions causing the image forming device to perform the steps of:

exposing a photoreceptor drum with a plurality of light emitting segments aligned in parallel to a main scanning direction, wherein each light emitting segment includes a plurality of light emitting elements, and wherein the photoreceptor drum includes a photoreceptor having a target surface that is scanned in the main scanning direction and a sub-scanning direction orthogonal to the main scanning direction;

adjusting an image writing position on the target surface in the sub-scanning direction and selectively driving the plural light emitting segments;

storing a profile in which a respective position of each of the plural light emitting segments corresponds to a correction amount from the main scanning direction toward the sub-scanning direction at every position; and smoothing a local change of the correction amount in the stored profile according to at least one of a first difference between the correction amount for a local light emitting segment and the correction amount for a first light emitting segment proximate the local light emitting segment in a first direction and a second difference between the correction amount for the local light emitting segment and the correction amount for a second light emitting segment proximate the local light emitting segment in a second direction opposite the first direction, wherein the step of smoothing includes obtaining the correction amount for the first light emitting segment and the correction amount for the second light emitting segment, for each of the continuous light emitting segments, and determining whether or not the obtained correction amounts are equal so that:

when the obtained correction amounts are determined to be equal, the correction amount for the current local light emitting segment is changed according to one of the obtained correction amounts, and when the obtained correction amounts are determined to not be equal, the correction amount of the current local light emitting segment is changed to the obtained correction amount which is nearer in value to the correction amount of the current local light emitting segment.

14. The computer readable medium according to claim 13, wherein the step of smoothing comprises:

obtaining the first difference and the second difference; and comparing the differences with each other.

15. The computer readable medium according to claim 13, wherein the step of smoothing comprises:

approximating the plural correction amounts within the range of the change according to the correction amounts at the outside positions in the range.

16. The computer readable medium according to claim 13, wherein the exposure head includes a lens for imaging light from the plural light emitting segments to the variable target surface and the instructions cause the image forming device to perform the further steps of:

smoothing a correction amount generated to correct the passage of the light from the plural light emitting segments through the lens.

17. The computer readable medium according to claim 13, wherein the plurality of light emitting elements are light emitting diodes.

* * * * *